US008707599B2

(12) United States Patent
White et al.

(10) Patent No.: US 8,707,599 B2
(45) Date of Patent: Apr. 29, 2014

(54) ADJUSTABLE SIGN HOLDER

(75) Inventors: Michael J. White, Ripon, WI (US); Paul White, Libertyville, IL (US)

(73) Assignee: K-International, Inc., Gurnee, IL (US)

( * ) Notice: Subject to any disclaimer, the term of this patent is extended or adjusted under 35 U.S.C. 154(b) by 367 days.

(21) Appl. No.: 13/180,055

(22) Filed: Jul. 11, 2011

(65) Prior Publication Data

US 2012/0110883 A1 May 10, 2012

Related U.S. Application Data

(60) Provisional application No. 61/412,069, filed on Nov. 10, 2010.

(51) Int. Cl.
*G09F 3/20* (2006.01)
*G09F 15/00* (2006.01)

(52) U.S. Cl.
CPC ..... *G09F 15/00* (2013.01)
USPC ..... 40/661.03

(58) Field of Classification Search
CPC ..... G09F 15/00
See application file for complete search history.

(56) References Cited

U.S. PATENT DOCUMENTS

| | | | | |
|---|---|---|---|---|
| 6,568,112 | B2 * | 5/2003 | Lowry et al. | 40/661.03 |
| 6,571,498 | B1 * | 6/2003 | Cyrluk | 40/661.03 |
| 6,796,445 | B2 * | 9/2004 | Cyrluk | 211/183 |
| 6,868,629 | B2 * | 3/2005 | Fast et al. | 40/661.03 |
| 6,898,885 | B1 * | 5/2005 | Nagel | 40/661.06 |
| 7,316,089 | B2 * | 1/2008 | Brinkman | 40/642.02 |
| 7,322,138 | B2 * | 1/2008 | Gormley et al. | 40/658 |
| 7,325,348 | B2 * | 2/2008 | Mueller et al. | 40/649 |
| 7,627,971 | B2 * | 12/2009 | Fast | 40/661.03 |
| 7,726,057 | B2 * | 6/2010 | Brinkman et al. | 40/661.03 |
| 2008/0282592 | A1 * | 11/2008 | Brinkman et al. | 40/661.03 |
| 2009/0320344 | A1 * | 12/2009 | Barkdoll et al. | 40/661.03 |
| 2013/0008065 | A1 * | 1/2013 | Danielson | 40/606.01 |

* cited by examiner

*Primary Examiner* — Shin Kim
(74) *Attorney, Agent, or Firm* — Schiff Hardin LLP

(57) ABSTRACT

A sign holder has a main portion, a sign or display holding member, a detachable portion, and a breakaway portion. The main portion has a first gripping member and at least first and second receiving members. The sign or display holding member is attached to the main portion and is arranged to releasably and frictionally hold a sign or display. The detachable portion includes a second gripping member and an engagement member. The breakaway portion detachably attaches the main portion and the detachable portion to one another. The engagement member is arranged to engage one of the first and second receiving members in a manner permitting the first and second gripping members to grip a fixture so as to hold the sign holder to the fixture.

38 Claims, 11 Drawing Sheets

ADJUSTABLE SIGN HOLDER

RELATED APPLICATION

This application claims the benefit of U.S. Provisional Application No. 61/412,069, filed Nov. 10, 2010.

TECHNICAL FIELD

The disclosure of this application relates to an adjustable sign holder of the type that can be used to attach a sign and/or a display to different sized fixtures in an establishment such as a retail store.

BACKGROUND

Many known fastening methods for attaching a sign and/or a display to a fixture include use of pressure sensitive adhesive, metal fasteners, plastic fasteners, and gripping fasteners. A gripping fastener requires that the fastener be dimensioned such that it grips a fixture with sufficient pressure to support a sign or display.

Due to the inconsistencies of the sizes and shapes of fixtures to which a sign holder is to be attached, an establishment such as a store or chain of stores may require numerous differently dimensioned gripping fasteners to accommodate all fixtures.

DETAILED DESCRIPTION

Figure 1:
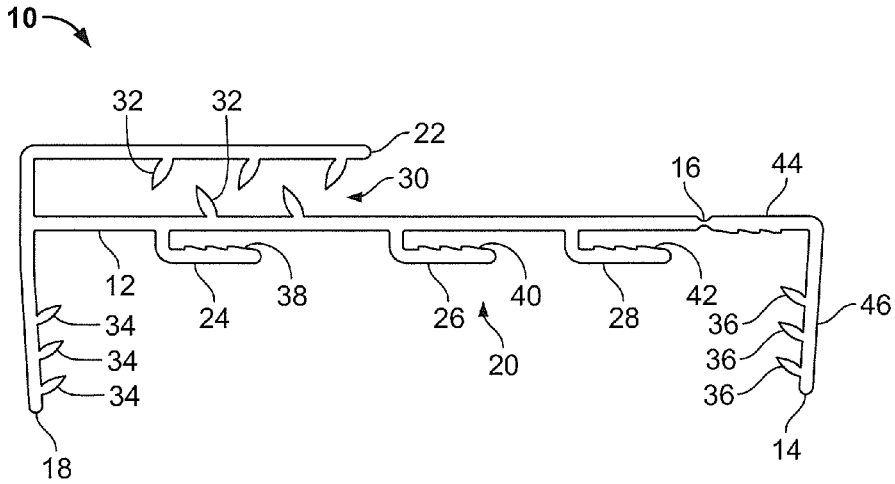
FIG. 1 shows first embodiment of a sign holder.

A sign holder 10 as shown in FIGS. 1 and 6-8 includes a main portion 12 and a detachable portion 14 connected to one another at a breakaway portion 16. The main portion 12 includes a shelf gripping member 18, a plurality of receiving members 20 in the form of pockets, and a sign or display holding member 22. The shelf gripping member 18 is arranged to grip one side of a fixture. The plurality of pockets 20 may include, for example, pockets 24, 26, and 28. The pockets 20, for example, may have open ends and one, two, or no open sides.

The sign or display holding member 22 releasably and frictionally holds a sign or display, such as a sheet of plastic, card, paper, or the like. The sign or display holding member 22 forms a U-shaped channel 30 that receives the sign or display. The U-shaped channel 30 includes flexible fins 32 that are oriented such that they point rearwardly into the U-shaped channel 30. The flexible fins 32 flex rearwardly to allow a sign or display to be inserted, but resist removal of the sign or display by gripping the sign or display when an attempt is made to pull the sign or display outwardly.

Also, the shelf gripping member 18 includes flexible fins 34, and the detachable portion 14 includes flexible fins 36. The flexible fins 34 and 36 grip a shelf when the sign holder 10 is applied to the shelf.

The pockets 24, 26, and 28 include corresponding slots 38, 40, and 42 having the open ends. In FIG. 1, the open ends of the slots 38, 40, and 42 are pointed toward the detachable portion 14. The detachable portion 14 includes an engagement member 44 and gripper member 46 forming a somewhat less than 90° angle. The gripper member 46 of the detachable portion 14 includes the flexible fins 36.

The breakaway portion 16, for example, may comprise a depression or a narrowing of the material between the main portion 12 and the detachable portion 14. This depression or narrowing follows a line (into the paper as viewed in FIG. 1) that divides the main portion 12 from the detachable portion 14 and makes it relatively easy to break the material of the sign holder 10 when detaching the detachable portion 14 from the main portion 12. Yet the depression or narrowing of the material between the main portion 12 and the detachable portion 14 need not be so shallow as to prevent the sign holder 10 from engaging and gripping the widest shelf for which the sign holder 10 is designed.

For a narrow shelf, the detachable portion 14 is detached at the breakaway portion 16 from the main portion 12, and the engagement member 44 of the detachable portion 14 is inserted through the open end of and into the slot 38 of the pocket 24 such that the flexible fins 34 and 36 face one another. Then, the sign holder 10 is applied to the narrow shelf such that the flexible fins 34 engage one side of the narrow shelf and such that the flexible fins 36 engage the other side of the narrow shelf. In this manner, the flexible fins 34 and 36 of the sign holder 10 grip the narrow shelf to hold the sign holder 10 to the narrow shelf.

If the shelf is less narrow than the narrow shelf, the detachable portion 14 is detached at the breakaway portion 16 from the main portion 12, and the engagement member 44 of the detachable portion 14 is inserted through the open end and into the slot 40 of the pocket 26 such that the flexible fins 34 and 36 face one another. Then, the sign holder 10 is applied to the somewhat less narrow shelf such that the flexible fins 34 engage one side of the somewhat less narrow shelf and the flexible fins 36 engage the other side of the somewhat less narrow shelf. In this manner, the flexible fins 34 and 36 of the sign holder 10 grip the somewhat less narrow shelf to hold the sign holder 10 to the somewhat less narrow shelf.

If the shelf is still less narrow than with the narrow shelf or the less narrow shelf, the detachable portion 14 is detached at the breakaway portion 16 from the main portion 12, and the engagement member 44 of the detachable portion 14 is inserted through the open end and into the slot 42 of the pocket 28 such that the flexible fins 34 and 36 face one another. Then, the sign holder 10 is applied to the still less narrow shelf such that the flexible fins 34 engage one side of the still less narrow shelf and the flexible fins 36 engage the other side of the still less narrow shelf. In this manner, the flexible fins 34 and 36 of the sign holder 10 grip the still less narrow shelf to hold the sign holder 10 to the still less narrow shelf.

If the shelf is the widest shelf for which the sign holder 10 is designed, the detachable portion 14 is not detached at the breakaway portion 16 from the main portion 12. Instead, the sign holder 10 is applied directly to the widest shelf such that the flexible fins 34 engage one side of the widest shelf and the flexible fins 36 engage the other side of the widest shelf. In this manner, the flexible fins 34 and 36 of the sign holder 10 grip the widest shelf to hold the sign holder 10 to the widest shelf.

The surface of the pocket 24 facing the corresponding slot 38 and the surface of the engagement member 44 of the detachable portion 14 that engages one another may be roughened or otherwise treated so as to increase the friction therebetween, such that the engagement member 44 resists withdrawal from the pocket 24. The corresponding engagement surfaces of the pockets 26 and 28 may be similarly treated. As a further alternative, the engagement between the main and detachable portions 12 and 14 of the sign holder 10 may include a ratcheting interface for fine adjustment. As a still further alternative, the engagement between the engagement member 44 and the pockets 24, 26, and 28 may be mechanical or adhesive.

The sign holder 10 may be extruded using a suitable material such as a flexible plastic.

Figure 2:
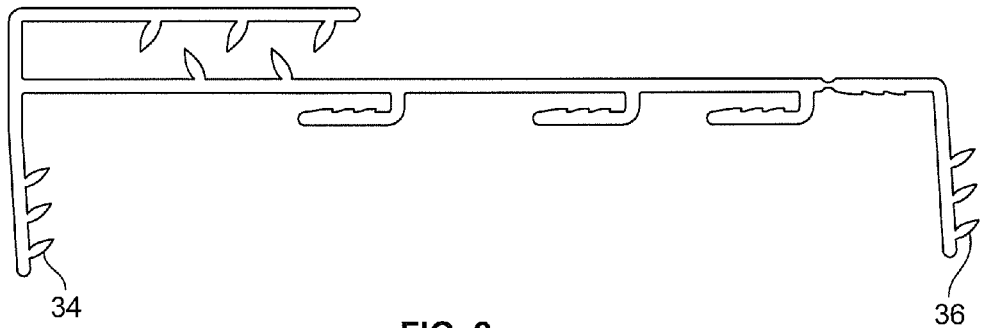
FIG. 2 shows a second embodiment of a sign holder.

FIG. 2 shows an alternative sign holder that differs from the sign holder 10 primarily in that (i) the open ends of the slots of the pockets point toward the end of the main portion 12 having the flexible fins 34 and (ii) the flexible fins 36 are disposed oppositely on the detachable portion 14 as shown in FIG. 1.

Figure 3:
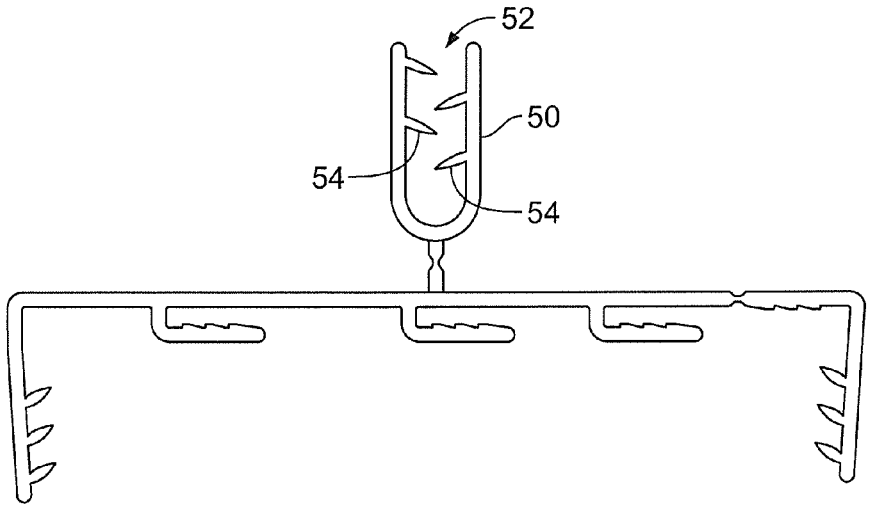
FIG. 3 shows a third embodiment of a sign holder.

FIG. 3 shows another alternative sign holder that differs from the sign holder 10 primarily in that the sign or display holding member 22 having the U-shaped channel 30 that receives the sign or display is replaced by a sign or display holding member 50 having a U-shaped channel 52 that receives the sign or display. The U-shaped channel 52 includes flexible fins 54 that are oriented such that they point rearwardly in to the U-shaped channel 52. The flexible fins 54 flex rearwardly to allow a sign or display to be inserted but resist removal of the sign or display by gripping the sign or display when an attempt is made to pull the sign or display outwardly. The sign or display holding member 50 also includes a flexible hinge 56 that connects the sign or display holding member 50 to the remainder of the main portion 12.

Figure 4:
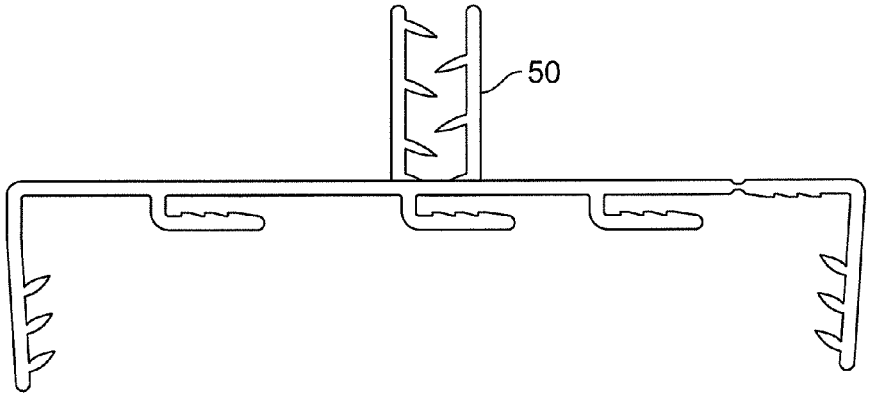
FIG. 4 shows a fourth embodiment of a sign holder.

FIG. 4 shows still another alternative sign holder that differs from the sign holder of FIG. 3 in that the sign or display holding member 50 is attached directly to the remainder of the main portion 12 without use of the flexible hinge.

Figure 5:
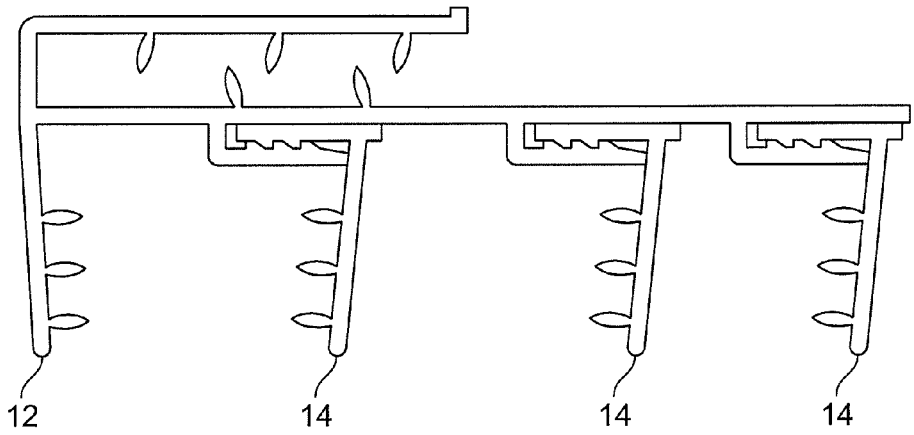
FIG. 5 shows a detachable portion of the sign holder applied to pockets of a main portion of the sign holder.

FIG. 5 shows the detachable portion 14 applied to each of the pockets 20.

Figure 6:
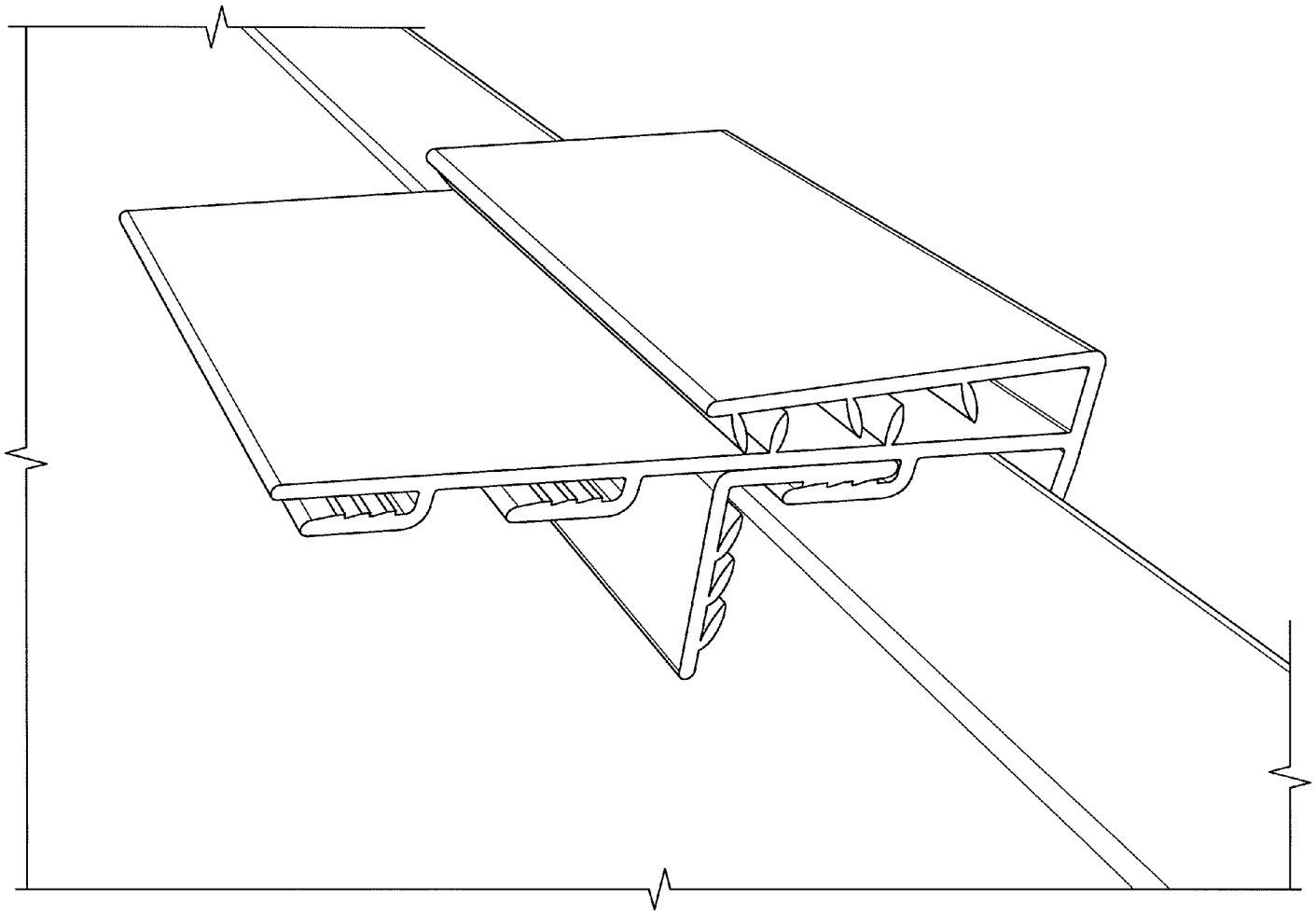
FIG. 6 shows the sign holder mounted to a narrow shelf.

FIG. 6 shows the sign holder mounted to the narrow shelf.

Figure 7:
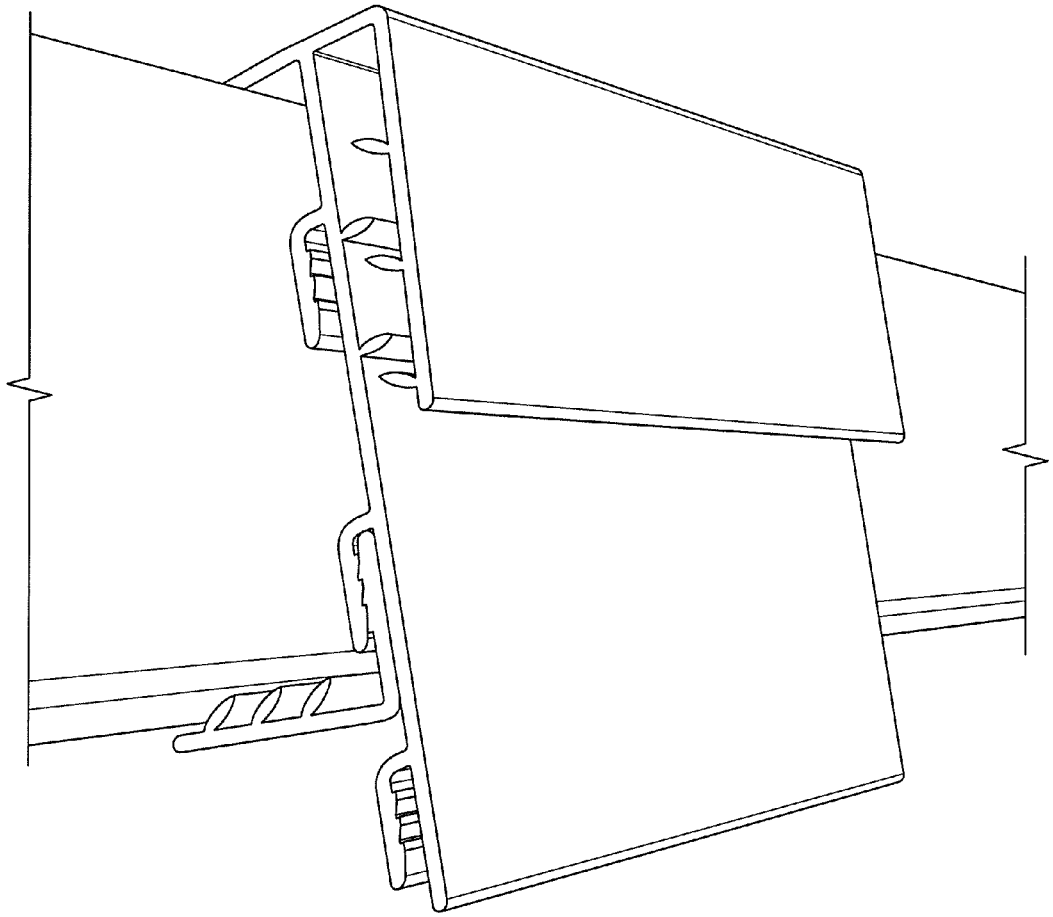
FIG. 7 shows the sign holder mounted to a less narrow shelf.

FIG. 7 shows the sign holder mounted to the less narrow shelf.

Figure 8:
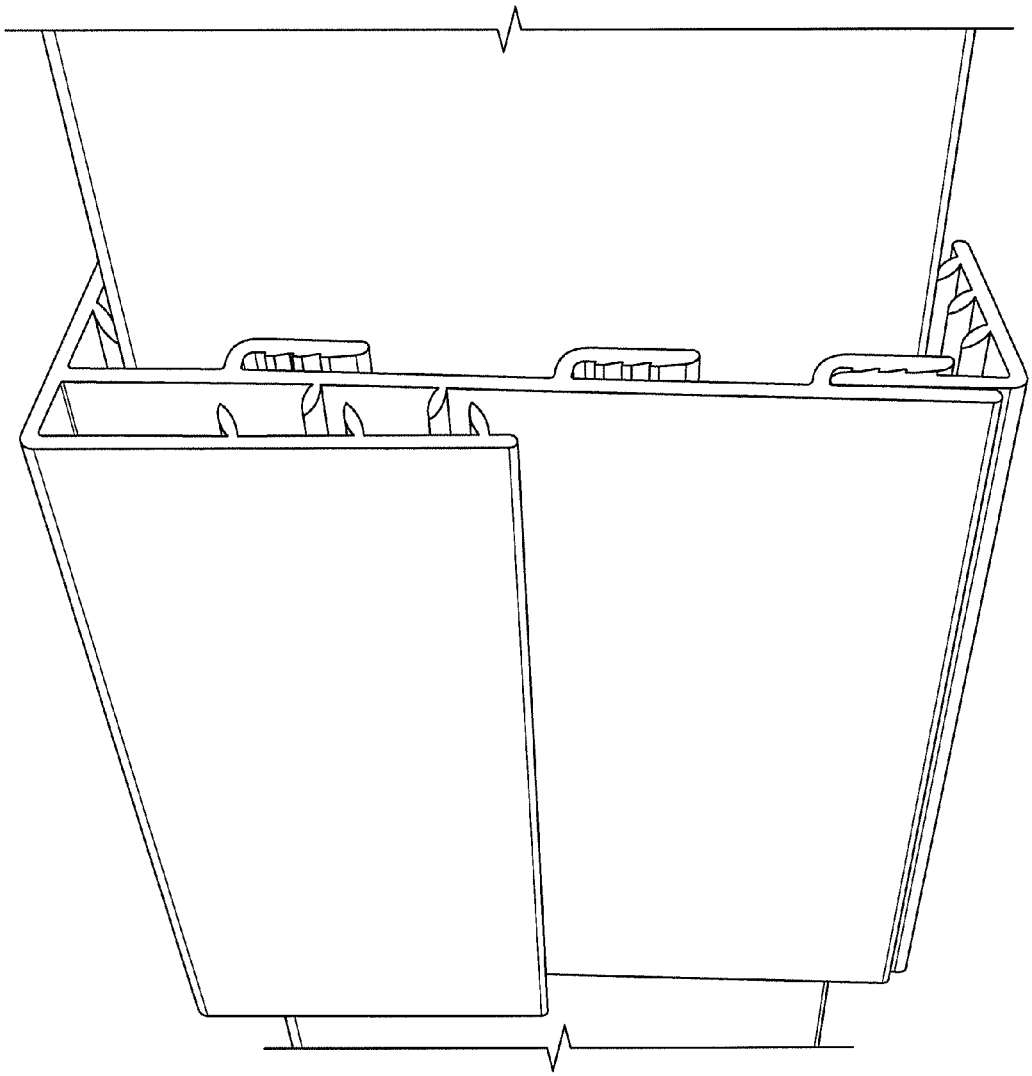
FIG. 8 shows the sign holder mounted to a wider shelf.

FIG. 8 shows the sign holder mounted to the still less narrow shelf.

Accordingly, the sign holder 10 is arranged to grip different sized fixtures by adjusting the position of the detachable portion 14 relative to the main portion 12. Furthermore, the sign holder 10 is manufactured and delivered in one piece. Once in the field, the sign holder 10 is bent to separate the main and detachable portions 12 and 14 from one another, if necessary. If it is necessary to detach the main and detachable portions 12 and 14 from one another, the fixture dimension is determined, and the main and detachable portions 12 and 14 of the sign holder 10 are engaged to one another as described above.

Figure 9:
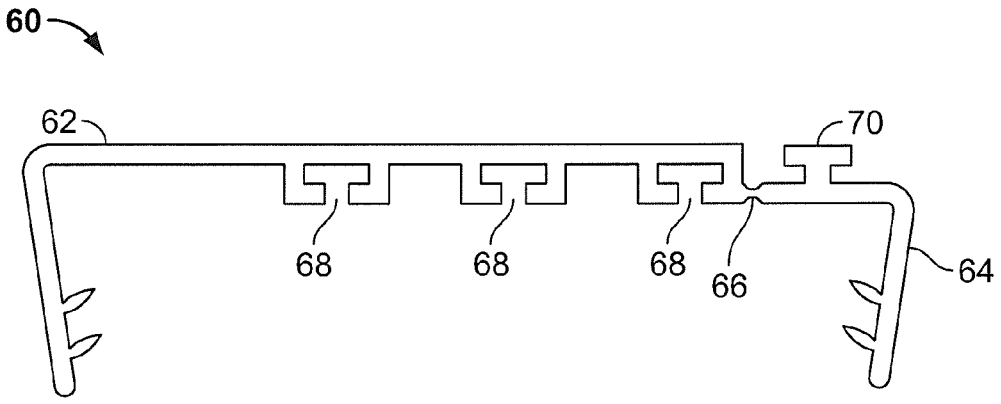
FIG. 9 shows an embodiment of a sign holder having alternative receiving members.

Shown in FIG. 9 is a sign holder 60 similar to the sign holder 10. The sign holder 60 includes a main portion 62 and a detachable portion 64 connected to one another at a breakaway portion 66. The main portion 62 includes a plurality of receiving members 68 in the form of elongated T-shaped channels that extend into the page of FIG. 9. The detachable portion 64 includes an engagement member 70 in the form of an elongated T-shaped rail. As before, the detachable portion 64 is detached at the breakaway portion 66 from the main portion 62, and the engagement member 70 is inserted into an appropriate one of the receiving members 68 dependent upon the size of the fixture to be gripped by the sign holder 60.

Figure 10:
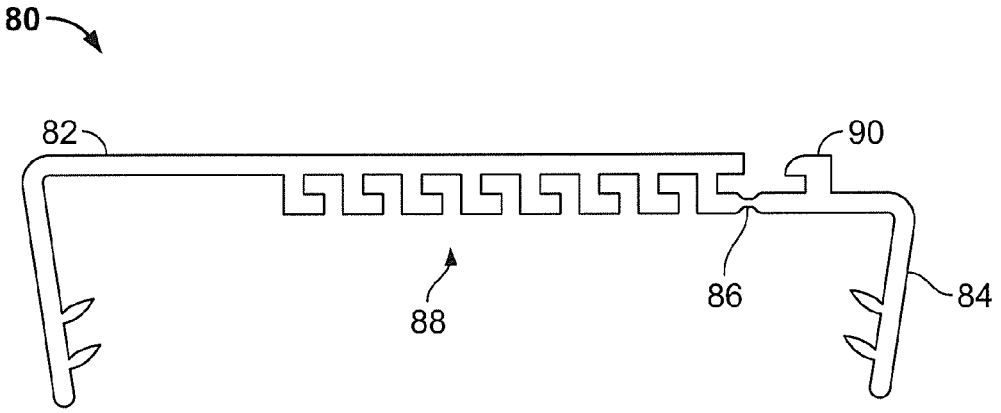
FIG. 10 shows an embodiment of a sign holder having an alternative engagement member.

Shown in FIG. 10 is a sign holder 80 similar to the sign holder 10. The sign holder 80 includes a main portion 82 and a detachable portion 84 connected to one another at a breakaway portion 86. The main portion 82 includes a plurality of receiving members 88 in the form of pockets that extend into the page of FIG. 10. The detachable portion 84 includes an engagement member 90 in the form of an elongated L-shaped rail. As before, the detachable portion 84 is detached at the breakaway portion 86 from the main portion 82, and the engagement member 90 is inserted into an appropriate one of the receiving members 88 dependent upon the size of the fixture to be gripped by the sign holder 80.

Figure 11:
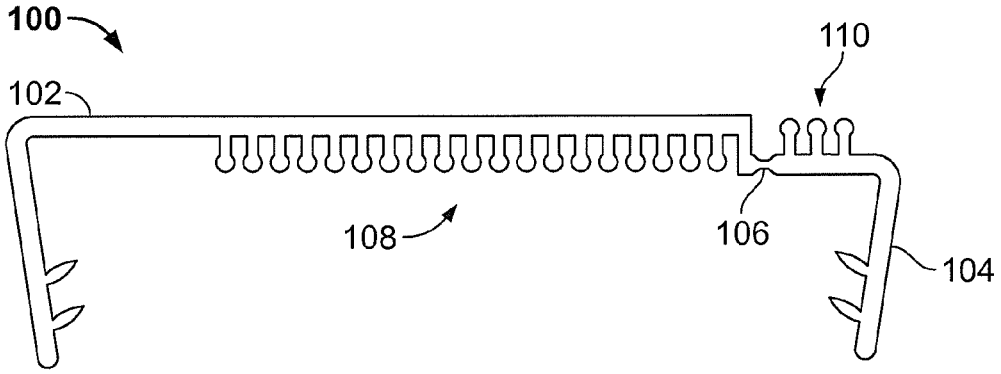
FIGS. 11-16 show embodiments of a sign holder having various alternative receiving and engagement members.

Shown in FIG. 11 is a sign holder 100 similar to the sign holder 10. The sign holder 100 includes a main portion 102 and a detachable portion 104 connected to one another at a breakaway portion 106. The main portion 102 includes a plurality of receiving members 108 in the form of elongated rails that have enlarged rounded ends forming pockets and that extend into the page of FIG. 11. The detachable portion 104 includes an engagement member 110 in the form of a lesser number of elongated rails that have enlarged rounded ends and that extend into the page of FIG. 11. As before, the detachable portion 104 is detached at the breakaway portion 106 from the main portion 102, and the engagement member 110 is slid through appropriate ones of the receiving members 108 dependent upon the size of the fixture to be gripped by the sign holder 100.

Figure 12:
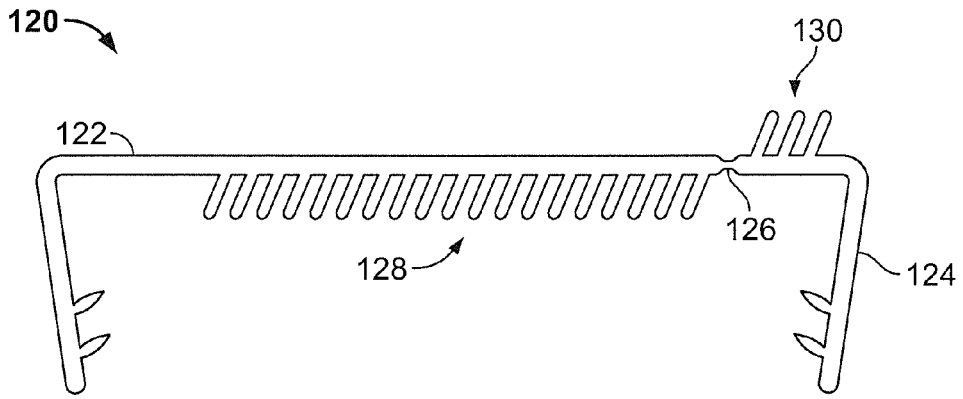

Shown in FIG. 12 is a sign holder 120 similar to the sign holder 10. The sign holder 120 includes a main portion 122 and a detachable portion 124 connected to one another at a breakaway portion 126. The main portion 122 includes a plurality of receiving members 128 in the form of elongated slanted rails extending into the page of FIG. 12. The detachable portion 124 includes an engagement member 130 in the form of a lesser number of elongated slanted rails extending into the page of FIG. 12. As before, the engagement member 130 is slid through appropriate ones of the receiving members 128 dependent upon the size of the fixture to be gripped by the sign holder 120.

Figure 13:
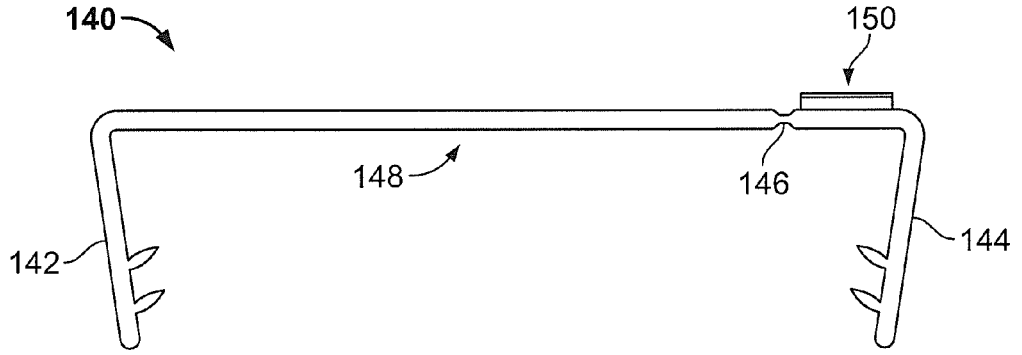

Shown in FIG. 13 is a sign holder 140 similar to the sign holder 10. The sign holder 140 includes a main portion 142 and a detachable portion 144 connected to one another at a breakaway portion 146. The main portion 142 includes a receiving member 148 in the form of an underside of the main portion 142. The detachable portion 144 includes an engagement member 150 in the form of an adhesive such as an elongated adhesive pad extending into the page of FIG. 13. The engagement member 150 is bonded to the receiving member 148 dependent upon the size of the fixture to be gripped by the sign holder 140.

Figure 14:
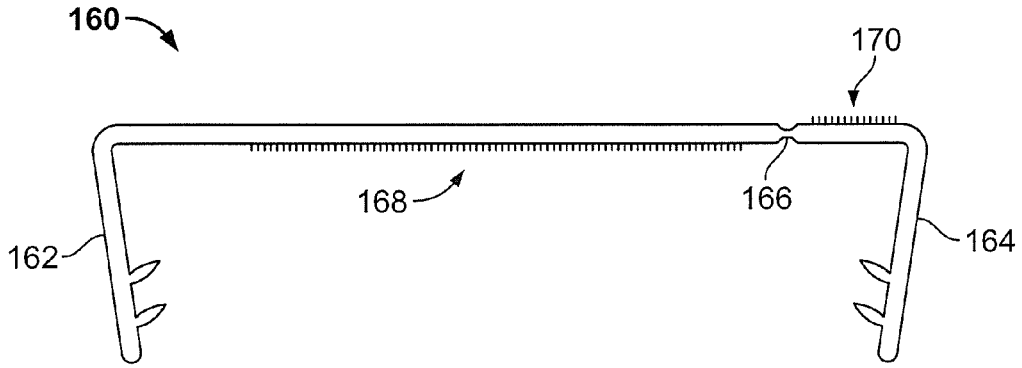

Shown in FIG. 14 is a sign holder 160 similar to the sign holder 10. The sign holder 160 includes a main portion 162 and a detachable portion 164 connected to one another at a breakaway portion 166. The main portion 162 includes a plurality of receiving members 168 in the form of hooks and loops extending into the page of FIG. 14. The detachable portion 164 includes an engagement member 170 in the form of a lesser number of elongated hooks and loops extending into the page of FIG. 14. As before, the engagement member 170 is applied to the receiving members 168 so that the hooks and loops of the receiving members 168 and the engagement member 170 engage one another at a position that depends upon the size of the fixture to be gripped by the sign holder 160.

Figure 15A:
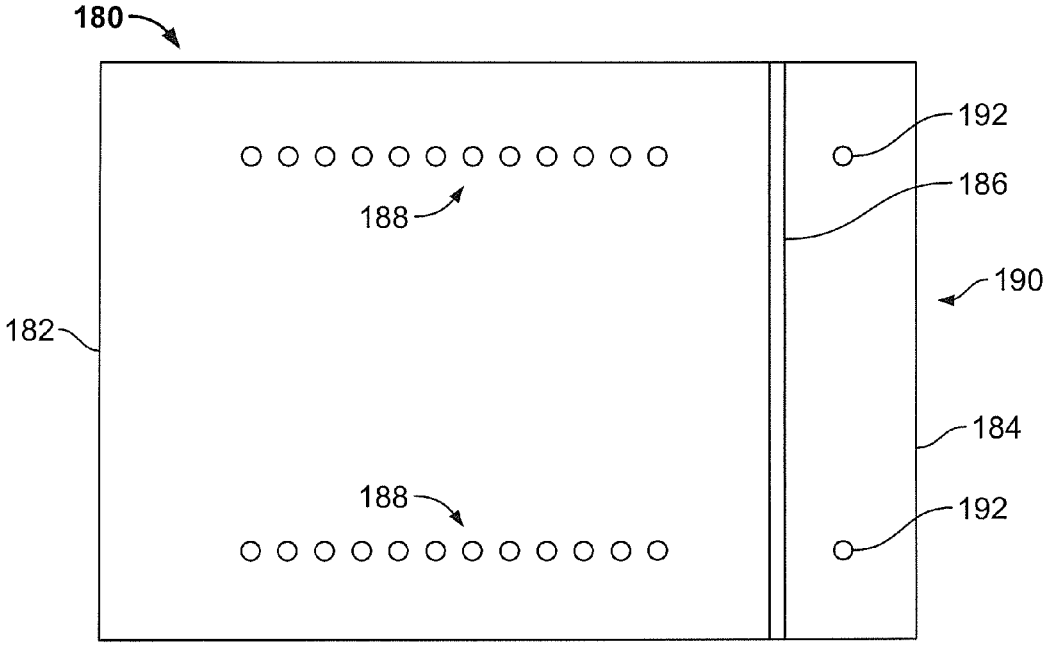
Figure 15B:
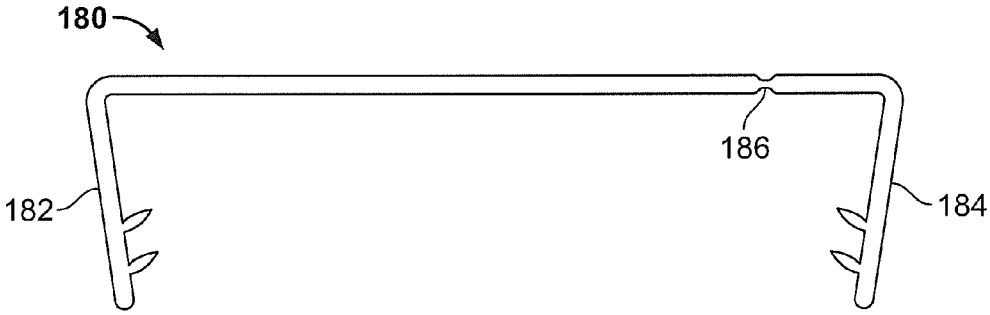
Figure 15C:
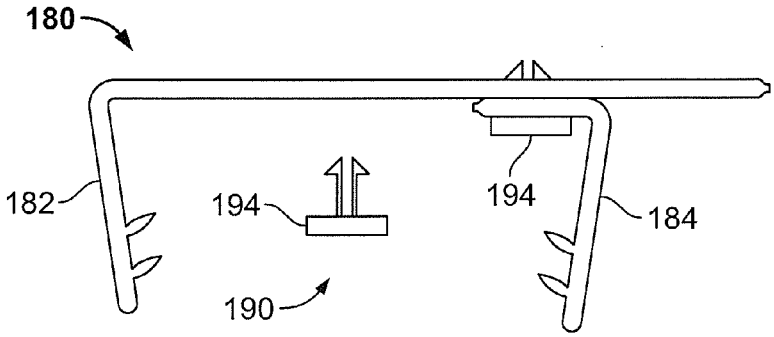

Shown in the top view of FIG. 15A and the side view of FIG. 15B and the assembly view of FIG. 15C is a sign holder 180 similar to the sign holder 10. The sign holder 180 includes a main portion 182 and a detachable portion 184 connected to one another at a breakaway portion 186. The main portion 182 includes a plurality of receiving members 188 in the form of two rows of holes as shown in FIG. 15A. The detachable portion 184 includes an engagement member 190 in the form of a pair of holes 192 shown in FIG. 15A and a pair of prong members 194 one of which is shown in FIG. 15C. Each of the prong members 194 is pushed through a corresponding one of the holes 192 and a corresponding one of the holes of the receiving member 188 as appropriate for the size of the fixture to be gripped by the sign holder 180. The prong members 194 are shown separate from the detachable portion 204 but instead may be integral with the detachable portion 204.

Figure 16A:
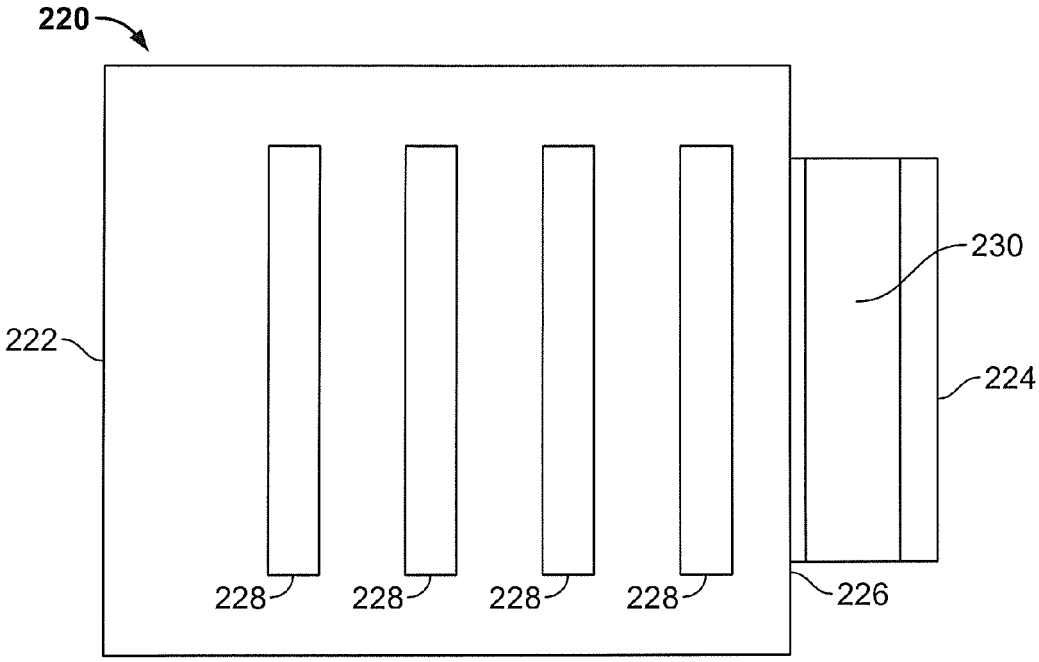
Figure 16B:
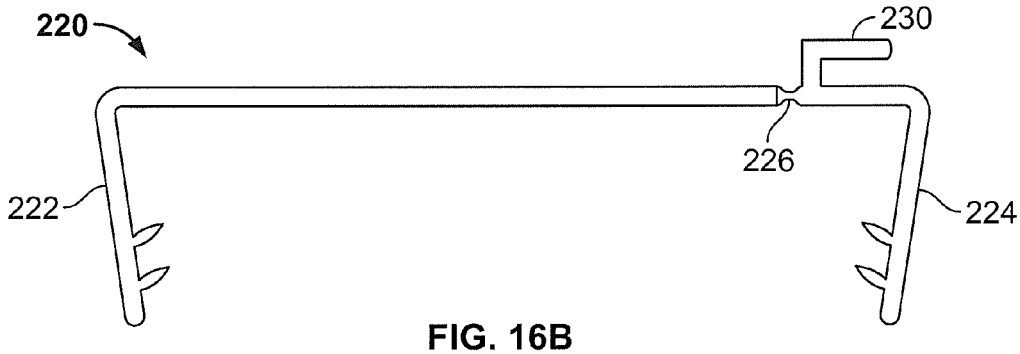

Shown in the top view of FIG. 16A and the side view of FIG. 16B is a sign holder 220 similar to the sign holder 10. However, the sign holder 220 includes a main portion 222 and a detachable portion 224 connected to one another at a breakaway portion 226. The main portion 222 includes a plurality of receiving members 228 in the form of elongated slots as shown in FIG. 16A. The detachable portion 224 includes an engagement member 230 in the form of an L-shaped rail as shown in FIGS. 16A and 16B. The engagement member 230 is inserted through an appropriate one of the receiving member 228 dependent upon the size of the fixture to be gripped by the sign holder 220.

Figure 17:
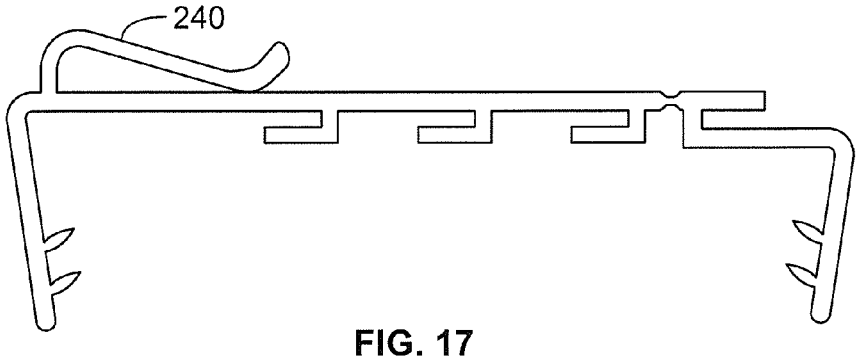
FIGS. 17-20 show embodiments of a sign holder having various alternative sign or display holding members; and, FIG. 21 shows an alternative embodiment of a sign holder having curved gripping members.
Figure 18:
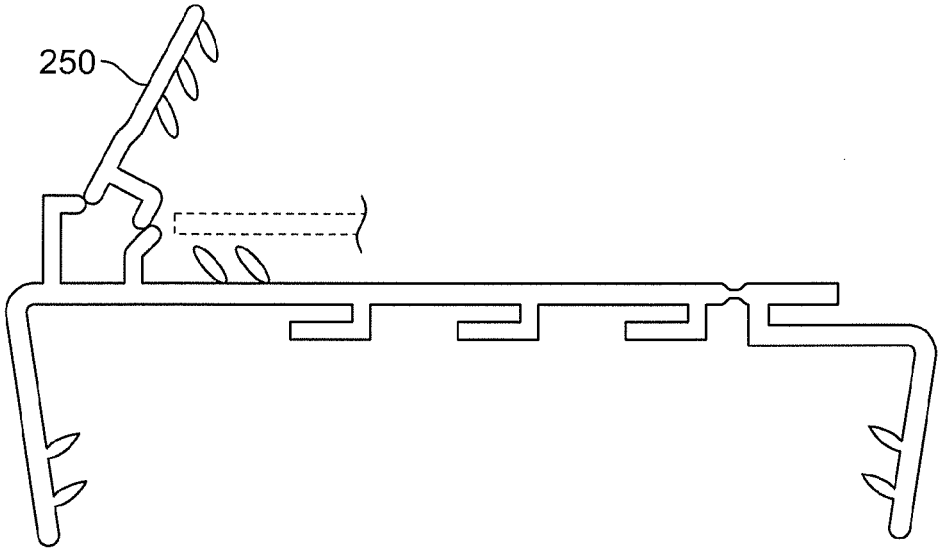
Figure 19:
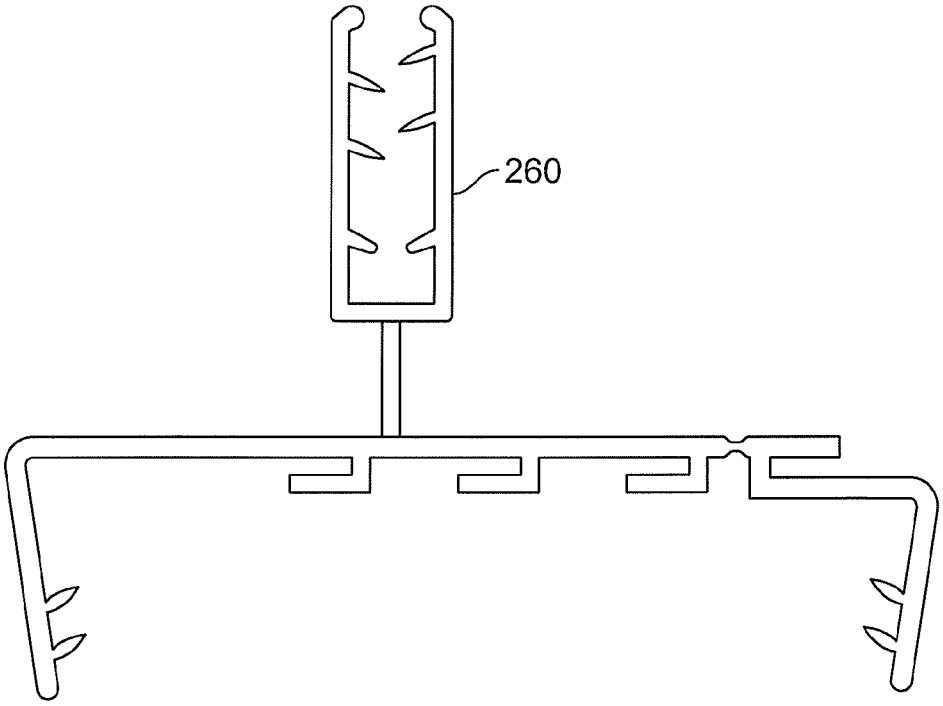
Figure 20:
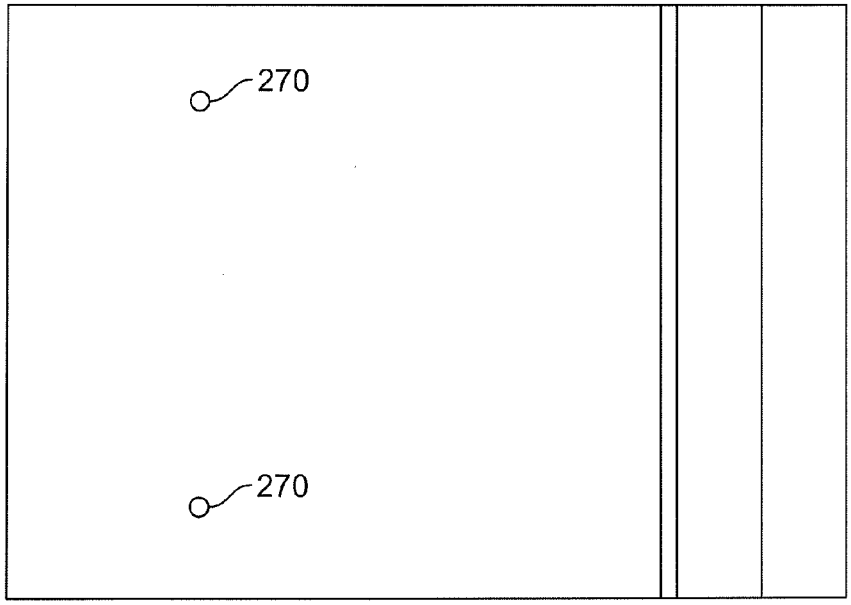

FIGS. 17-20 show various sign or display holding members that may be used as alternatives to the sign or display holding members 22 and 50. Accordingly, a sign or display holding member 240 of FIG. 17 is clip type holder that holds a sign or display flush with the sign holder. A sign or display holding member 250 of FIG. 18 is flexible hinge type holder that clamps a sign or display to the sign holder. A sign or display holding member 260 of FIG. 18 is a holder that holds a sign or display perpendicularly to the sign holder. A sign or display holding member 270 of FIG. 19 is a one or more holes in the main portion of a sign holder that cooperates with push pins or other devices to hold a sign or display flush with the sign holder.

Figure 21:
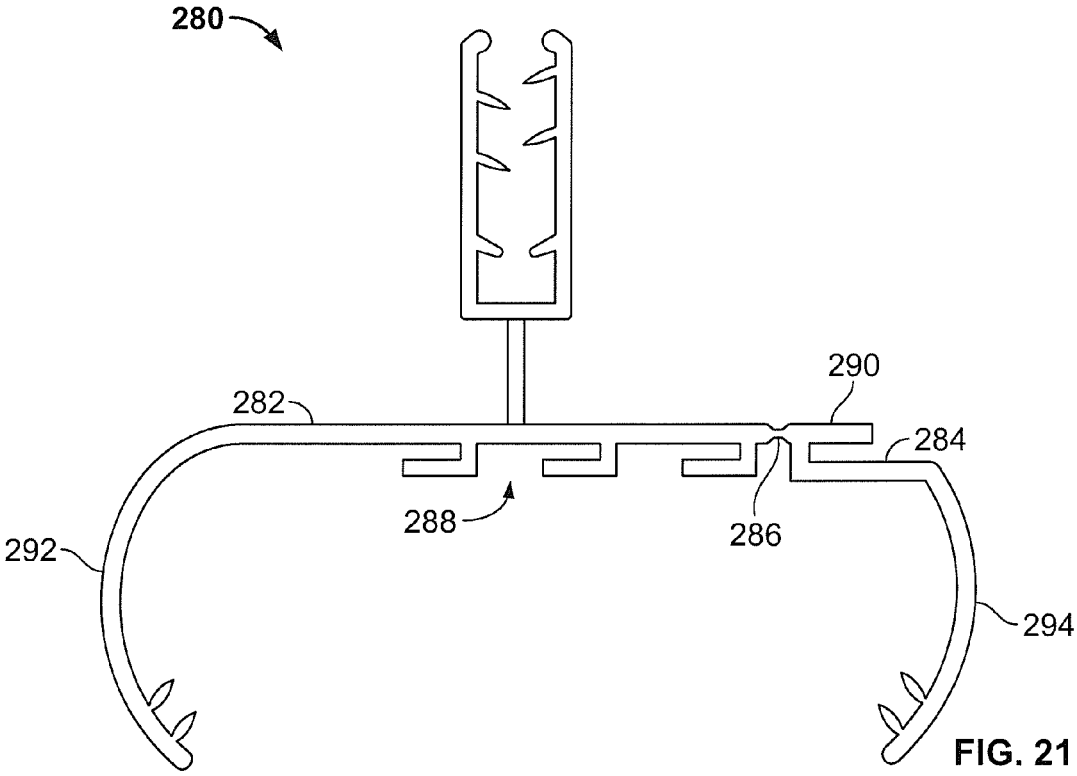

Shown in FIG. 21 is a sign holder 280 similar to the sign holder 10. The sign holder 280 includes a main portion 282 and a detachable portion 284 connected to one another at a breakaway portion 286. The main portion 282 includes a plurality of receiving members 288 in the form of pockets. The detachable portion 284 includes an engagement member 290 in the form of a leg that engages one of the pockets. The main portion 282 has a curved gripping member 292, and the detachable portion 284 has a curved gripping member 294. The curved gripping members 292 and 294 permit the sign holder 280 to be mounted to and grip cylindrical fixtures such as poles, pipes, and tubes.

Certain modifications of the present invention have been discussed above. Other modifications will occur to those practicing in the art of the present invention. For example, although the sign holder 10 is described above for mounting signs or displays to shelves, the sign holder 10 can be used to mount signs or displays to other devices such as posts.

Also, as disclosed above, the sign holder 10 has the main portion 12 and the detachable portion 14 connected to one another at the breakaway portion 16 such that, when the sign holder is to be first used, the detachable portion 14 is detached at the breakaway portion 16 from the main portion 12 and the engagement member 44 of the detachable portion 14 is applied to the main portion 12. However, the main portion 12 and the detachable portion 14 may be alternatively supplied as two separate unattached portions not requiring detachment for first use.

Moreover, the sign or display holding member 22 is shown as part of the main portion 12. Instead, the sign or display holding member 22 may be part of the detachable portion 14.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A sign holder comprising:

a first sign holder portion, wherein the first sign holder portion has a first gripping member and at least first and second receiving members;

a second sign holder portion, wherein the second sign holder portion includes a second gripping member and an engagement member, and wherein the engagement member is arranged to engage one of the first and second receiving members in a manner permitting the first and second gripping members to grip fixtures of different sizes so as to hold the sign holder to the fixtures; and, a sign or display holding member attached to one of the first and second sign holder portions and arranged to hold a sign or display.

2. The sign holder of claim 1 wherein the first sign holder portion comprises a main portion, and wherein the second sign holder portion comprises a detachable portion joined to the main portion by a breakaway portion detachably attaching the main portion and the detachable portion to one another, whereby the detachable portion may be detached from the main portion and the engagement member may be engaged to one of the first and second receiving members in a manner permitting the first and second gripping members to grip fixtures of different sizes so as to hold the sign holder to the fixtures.

3. The sign holder of claim 2 wherein the sign or display holding member comprises a channel parallel to the main portion.

4. The sign holder of claim 2 wherein the sign or display holding member further comprises flexible fins, and wherein the fins are arranged to hold a sign or display to the sign holder.

5. The sign holder of claim 2 wherein the sign or display holding member comprises a channel perpendicular the main portion.

6. The sign holder of claim 2 wherein the sign or display holding member comprises a channel and a hinge, wherein the channel receives the sign or display, and wherein the hinge attaches the channel perpendicular to the main portion.

7. The sign holder of claim 2 wherein the sign or display holding member comprises a clip.

8. The sign holder of claim 2 wherein the sign or display holding member comprises a hole in the main portion.

9. The sign holder of claim 2 wherein the at least first and second receiving members and the engagement member each comprises a surface treated so as to enhance friction between the engagement member and the first and second receiving members.

10. The sign holder of claim 9 wherein the surfaces of the engagement member and the first and second receiving members comprise ratcheting surfaces.

11. The sign holder of claim 2 wherein the detachable portion comprises first and second legs formed at an angle with respect to one another, wherein the first leg forms the engagement member, and wherein the second leg forms the second gripping member.

12. The sign holder of claim 2 wherein each of the at least first and second receiving members comprises T-shaped channels, and wherein the engagement member comprises a complementary T-shaped rail.

13. The sign holder of claim 2 wherein each of the at least first and second receiving members comprises pockets, and wherein the engagement member comprises a complementary L-shaped rail.

14. The sign holder of claim 2 wherein each of the at least first and second receiving members comprises elongated rails that have enlarged rounded ends forming pockets, and wherein the engagement member comprises a complementary elongated rail having an enlarged rounded end.

15. The sign holder of claim 2 wherein each of the at least first and second receiving members comprises elongated slanted rails, and wherein the engagement member comprises a complementary elongated slanted rail.

16. The sign holder of claim 2 wherein each of the at least first and second receiving members comprises an underside of the main portion, and wherein the engagement member comprises a complementary adhesive.

17. The sign holder of claim 2 wherein each of the at least first and second receiving members comprises hooks and loops, and wherein the engagement member comprises complementary hooks and loops.

18. The sign holder of claim 2 wherein each of the at least first and second receiving members comprises holes through the main portion, and wherein the engagement member comprises a hole and a pin that is inserted through one of the holes in the main portion and the hole in the engagement member.

19. The sign holder of claim 2 wherein each of the at least first and second receiving members comprises elongated slots through the main portion, and wherein the engagement member comprises a complementary L-shaped rail.

20. A method of holding a sign or a display on a fixture comprising:

inserting an engagement member of a first sign holder portion into one of a plurality of receiving members of a second sign holder portion such that a first gripping member of the first sign holder portion faces a second gripping member of the second sign holder portion such that the first and second sign holder portions are capable of being affixed to fixtures of different sizes;

applying the first and second gripping members to a fixture so that the first and second sign holder portions are secured to the fixture; and, attaching a sign or display to a sign or display holding member attached to one of the first and second sign holder portions.

21. The method of claim 20 wherein the first sign holder portion comprises a main portion, wherein the second sign holder portion comprises a detachable portion, wherein the detachable portion is joined to the main portion by a breakaway portion detachably attaching the main portion and the detachable portion to one another, and wherein the inserting of an engagement member of a first sign holder portion into one of a plurality of receiving members of a second sign holder portion comprises:

detaching the detachable portion from the main portion; and, inserting the engagement member into one of the plurality of receiving members of the main portion.

22. The method of claim 21 wherein the attaching of a sign or display to a sign or display holding member comprises inserting a sign or display into a channel that parallels the main portion.

23. The method of claim 21 wherein the attaching of a sign or display to a sign or display holding member comprises inserting a sign or display into a channel that is perpendicular to the main portion.

24. The method of claim 21 wherein the attaching of a sign or display to a sign or display holding member comprises inserting a sign or display into a channel having flexible fins that are arranged to hold a sign or display to the sign holder.

25. The method of claim 21 wherein the attaching of a sign or display to a sign or display holding member comprises inserting a sign or display into a member that is attached to the main portion by a hinge.

26. The method of claim 21 wherein the attaching of a sign or display to a sign or display holding member comprises pinning a sign or display to the main portion.

27. The method of claim 21 wherein the attaching of a sign or display to a sign or display holding member comprises clipping a sign or display to the main portion.

28. The method of claim 21 wherein the attaching of a sign or display to a sign or display holding member comprises frictionally attaching a sign or display to the main portion.

29. The method of claim 28 wherein the frictionally attaching of a sign or display to the main portion comprise frictionally attaching a sign or display to the main portion using ratcheting surfaces.

30. The method of claim 21 wherein the engagement member comprises a first leg of the detachable portion, and wherein the second gripping member comprises a second leg of the detachable portion.

31. The method of claim 21 wherein at least one of the receiving members comprises a T-shaped channel, and wherein the engagement member comprises a complementary T-shaped rail.

32. The method of claim 21 wherein at least one of the receiving members comprises a pocket, and wherein the engagement member comprises a complementary L-shaped rail.

33. The method of claim 21 wherein at least one of the receiving members comprises at least two elongated rails that have enlarged rounded ends forming a pocket therebetween, and wherein the engagement member comprises a complementary elongated rail having an enlarged rounded end.

34. The method of claim 21 wherein at least one of the receiving members comprises an elongated slanted rail, and wherein the engagement member comprises a complementary elongated slanted rail.

35. The method of claim 21 wherein at least one of the receiving members comprises an underside of the main portion, and wherein the engagement member comprises a complementary adhesive.

36. The method of claim 21 wherein the receiving members comprise hooks and loops, and wherein the engagement member comprises complementary hooks and loops.

37. The method of claim 21 wherein the receiving members comprise holes through the main portion, and wherein the engagement member comprises a hole and a pin that is inserted through one of the holes in the main portion and the hole in the engagement member.

38. The method of claim 21 wherein at least one of the receiving members comprises an elongated slot through the main portion, and wherein the engagement member comprises a complementary L-shaped rail.

* * * * *